US008320573B2

(12) United States Patent
Lundh et al.

(10) Patent No.: US 8,320,573 B2
(45) Date of Patent: Nov. 27, 2012

(54) ADAPTIVE HEARING DEVICE AND METHOD FOR PROVIDING A HEARING AID

(75) Inventors: Peter Lundh, Smørum (DK); Mark Flynn, Gothenburg (SE)

(73) Assignee: Oticon A/S, Smørum (DK)

( * ) Notice: Subject to any disclaimer, the term of this patent is extended or adjusted under 35 U.S.C. 154(b) by 666 days.

(21) Appl. No.: 12/337,162

(22) Filed: Dec. 17, 2008

(65) Prior Publication Data

US 2009/0154743 A1 Jun. 18, 2009

(30) Foreign Application Priority Data

Dec. 18, 2007 (EP) ..... 07123480

(51) Int. Cl.
*H04R 25/00* (2006.01)

(52) U.S. Cl. ..... 381/60

(58) Field of Classification Search ..... 381/312, 381/314, 315, 60; 600/25; 607/55, 57
See application file for complete search history.

(56) References Cited

U.S. PATENT DOCUMENTS

| | | | | |
|---|---|---|---|---|
| 6,658,122 | B1 | 12/2003 | Westermann et al. | |
| 6,785,394 | B1 * | 8/2004 | Olsen et al. | 381/312 |
| 2003/0215105 | A1 * | 11/2003 | Sacha | 381/312 |
| 2005/0036637 | A1 * | 2/2005 | Janssen | 381/315 |
| 2005/0105741 | A1 | 5/2005 | Niederdrank et al. | |
| 2007/0068728 | A1 | 3/2007 | Steinbuss | |
| 2008/0226106 | A1 * | 9/2008 | Rohrseitz | 381/314 |

FOREIGN PATENT DOCUMENTS

| | | | |
|---|---|---|---|
| DE | 195 42 961 | C1 | 5/1997 |
| DE | 10 2005 043348 | A1 | 12/2006 |
| EP | 0 681 411 | A1 | 11/1995 |
| EP | 1 594 344 | A2 | 11/2005 |
| EP | 1 617 705 | A2 | 1/2006 |
| EP | 1 708 544 | A1 | 10/2006 |

OTHER PUBLICATIONS

European Search Report dated Jun. 4, 2008.
Marlene P. Bagatto et al., "Real-Ear-To-Coupler Difference Predictions As a Function of Age for Two Coupling Procedures", Journal of the American Academy of Audiology, Jan. 1, 2002, vol. 13, No. 8, pp. 407-415, XP-009100302.
Harvey Dillon, "Measuring Hearing Aids in Couplers and Ear Simulators", Thieme, Chapter 4, 2001, pp. 75-79.
Harvey Dillon, "Special Hearing Aid Issues for Children", Hearing Aids, Chapter 15, pp. 416-419.

* cited by examiner

*Primary Examiner* — Kenneth Parker
*Assistant Examiner* — Yu Chen
(74) *Attorney, Agent, or Firm* — Buchanan Ingersoll & Rooney PC

(57) ABSTRACT

A hearing device having an input unit for converting an acoustic input to a first signal, an output unit for converting a second signal to an acoustic output and a signal processing unit for generating said second signal from said first signal based on a setting indicating a characteristic of a user's ear, said signal processing unit coupling said input unit and said output unit, to a corresponding method for providing a hearing aid and a corresponding computer program. In order to provide an adaptive hearing device and a method for providing a hearing aid which allow for a compensation for the change in a characteristic of a user's ear, in particular for the change to the ear of a child during growth and which are of a low complexity and do not need additional sensors.

20 Claims, 4 Drawing Sheets

ADAPTIVE HEARING DEVICE AND METHOD FOR PROVIDING A HEARING AID

The present invention is related to a hearing device comprising an input unit for converting an acoustic input to a first signal, an output unit for converting a second signal to an acoustic output and a signal processing unit for generating said second signal from said first signal based on a setting indicating a characteristic of a user's ear, said signal processing unit coupling said input unit and said output unit. The present invention is also related to a method for providing a hearing aid, comprising the steps of converting an acoustic input to a first signal, generating a second signal from said first signal based on a setting indicating a characteristic of a user's ear and converting said second signal to an acoustic output. The present invention is further related to a computer program for causing a hearing device to perform the steps of a method for providing a hearing aid when said computer program is executed on said hearing device.

One of the challenges in paediatric audiology is that children have ear canals with shorter lengths and narrower diameters in comparison to those of adults. Given that all audiometric prescriptions are based on an adult sized 2 cc coupler (cf. ANSI S3.3 or IEC 60126 standards concerning measurements of hearing aids with a 2 cc coupler) this results in children receiving more amplification and maximum power output (MPO) than necessary or advisable (typically 5-10 dB across frequency).

One approach to deal with this problem includes that the audiologist corrects for the error using the real ear to coupler difference (RECD). This is a well-known and verified approach, cf. e.g. Harvey Dillon, Hearing Aids, Thieme, 2001, TNY ISBN 1-58890-052-5, hereafter [Dillon], chapter 4, 'Electroacoustic performance and measurement', specifically chapter 4.1, 'Measuring Hearing Aids in Couplers and Ear Simiulators', pp. 75-79. The standard 2 cc (2 $cm^3$) coupler is larger than an average adult ear canal with a hearing aid 'installed', so a hearing aid generates a lower sound pressure level (SPL) in the 2 cc coupler than in the actual (average) ear canal. This difference is called the 'real ear to coupler difference, RECD. However, a disadvantage of this is approach is that the audiologist typically finds it cumbersome and problematic in daily clinical practice (for example with young children or children with disabilities not always sitting still). Further, the audiologist needs to schedule the child to attend an appointment regularly to update this difference. There is of course the risk that the audiologist may not update the predicted or calculated values over time resulting in the child receiving less amplification than would be beneficial. It is not unusual to observe hearing aid settings for a four year old child that are based on the RECD from the initial fitting (e.g. 3 years ago) and that the child complains that the hearing aid is too soft or that the aided audiogram has changed.

There are hearing devices known which allow for an in-situ-fitting, i.e. for a fitting or adapting of the hearing device in its operational environment, i.e. in a user's ear. These hearing devices provide a fitting mode and a listening mode. An example is disclosed in EP 1 617 705 A2. Such hearing devices allow for an easy fitting since no additional means for fitting are necessary. However, it is still necessary to ensure a regular and timely update or refitting.

In U.S. Pat. No. 6,658,122, US 2005/0105741 A1 and EP 1 594 344 A2 a different type of hearing devices is disclosed in which a characteristic of the user's ear may be measured during normal operation. To this end, U.S. Pat. No. 6,658,122 provides a feedback control by which the outputted signal is continuously corrected by means of sensing the sound signal in front of the eardrum. US 2005/0105741 A1 teaches to indirectly determine the sound pressure inside the auditory canal by determining the electrical input impedance of the earpiece. In EP 1 594 344 A2 it is disclosed to sense a signal representative of an acoustic signal at a position in front of the user's eardrum for determining a characteristic of the user's ear canal. This characteristic is used to adapt the gain of the hearing instrument. In general, there is provided a repeated measurement for which an additional sensor is needed, Especially for a continuous feedback, the hearing device has to be rather complex. [Bagatto et al.] deals with RECD predictions as a function of child age.

It is an object of the present invention to provide an adaptive hearing device and a method for providing a hearing aid which allow for a compensation for the change in a characteristic of a user's ear, in particular for the change to the ear of a child during growth and which are of a low complexity and do not need additional sensors.

According to the present invention an adaptive hearing device is provided, comprising: an input unit for converting an acoustic input to a first signal, an output unit for converting a second signal to an acoustic output, a signal processing unit for generating said second signal from said first signal based on a setting indicating a characteristic of a user's ear, said signal processing unit coupling said input unit and said output unit, a timing unit for generating a timing signal indicating elapsed time, and a control unit for storing said setting and for modifying said setting based on said timing signal, said control unit being coupled to said signal processing unit and to said timing unit.

Further, according to the present invention, a method for providing a hearing aid is provided, comprising the steps of: converting an acoustic input to a first signal, generating a second signal from said first signal based on a setting indicating a characteristic of a user's ear, converting said second signal to an acoustic output, generating a timing signal indicating elapsed time, and modifying said setting based on said timing signal.

It is intended that the structural features of the device described above and below, in the detailed description and in the claims can be combined with the method, when appropriately substituted by a corresponding process. Embodiments of the method have the same advantages as the corresponding systems.

Yet further, a computer program is provided according to the present invention for causing a hearing device according to the invention to perform the steps of a method according to the invention when said computer program is executed on said hearing device.

The invention is based on the insight that an adjustment of a hearing device or hearing aid to a changing environment may be achieved if—starting from an appropriate initial value—the setting or processing parameter(s) are changed based on the time elapsed. The change of the environment during time may be reflected by the adjustment of the hearing device also changing by time.

The invention provides a system by which the hearing aid can automatically make accurate and predictable adjustments to the signal processing, e.g. to the gain, (for example through RECD corrections) over time to reflect for example the growth of the child's ear canal. These adjustments are in accordance with measured or predicted (RECD) values as initial value, and as such the hearing sensation (e.g. due to amplification) to the child remains stable over time, i.e. the corrections for ear canal volume are adjusted as the child grows older. The present invention allows for example that the actual gain (real ear gain) and/or maximum power output (MPO) does not change over time, wherein without a proper adjustment it does change, it becomes lower over time, so sounds become less audible.

Benefits of the present invention to the audiologist may include:

- a reduction in the number of visits required by the child for the simple updating of adjustment parameters (e.g. RECD values),
- an improved service delivery for children in rural settings where frequent visits to the audiologist are not possible,
- an avoidance of a situation where corrections or adjustments (e.g. of RECD value) may not be continuously updated because the child does not attend the clinic or because the audiologist 'forgot' to enter new data or update the child's age in the fitting software, and
- the audiologist can rest assured that the child will always have reasonable (RECD) corrections.

The benefits for the user (e.g. child and family) may include:

- the child will have more accurate (gain and MPO) settings than without this invention, as it is not possible to manually update corrections daily, weekly or even monthly, even though for very young children significant ear canal changes will take place,
- the child and family will not have to attend as many appointments which are only scheduled for updating RECD corrections. For rural or busy families this would be a significant advantage.

According to one embodiment of the present invention said timing unit comprises a real-time clock for measuring time, an uptime clock for measuring an uptime in which said hearing device is in operation, and/or a power-up counter for counting a number of power-ups of said hearing device. A real-time clock allows for an exact measuring of the time, as it is independent from the power state (i.e. ON or OFF) of the hearing device. In contrast thereto, an uptime clock merely measures the time for which the hearing device is switched on. An advantage of the uptime clock over the real-time clock is lower power consumption. A further alternative for measuring time is a counter indicating how often the hearing device is switched on or off.

In a preferred embodiment of the present invention said timing unit comprises said uptime clock and said timing unit is adapted for generating said timing signal based on said uptime multiplied by a predetermined time-factor. The uptime clock measures merely the time of operation, i.e. the time the hearing device is switched on. From this time of operation, the actual time elapsed can be estimated. Accordingly, the actual elapsed time is calculated from the uptime by a multiplication by a given factor.

It is further preferred that said predetermined time-factor is in the range of 1.5 to 4.0, preferably in the range of 2 to 3, most preferably 2.4. It was found that in most cases a listening day, i.e. the uptime of a hearing device during one day, may be assumed to be about 10 hours.

According to another advantageous embodiment said timing unit comprises said power-up counter and said timing unit is adapted for generating said timing signal based on said number of power-ups multiplied by a predetermined time-value, wherein said predetermined time-value is preferably in the range of 6 hours to 24 hours. Another suitable way to estimate or determine the elapsed time in intervals of about a day is to count the number of switching-on or -off-operations to the hearing device. Such a counting does not need a clock and a mere counter is sufficient.

In a further embodiment of the present invention said control unit is adapted for modifying said setting based on said timing signal and a predefined look-up table. It is possible to store the settings to be used or the adjustments to the setting to be provided in a table or memory wherein the respective value is determined by means of the timing signal. According to this embodiment the hearing device contains a memory and does not need to have additional calculation capabilities.

In an alternative or in addition to the previous embodiment said control unit is adapted for modifying said setting based on said timing signal using a predefined function for calculating a modified setting. A predefined function or algorithm for determining the modified setting allows for deriving the correct value directly from the timing signal (and possibly from an initial or previous setting) with a need for only a very small memory capacity.

According to one embodiment of the present invention said control unit is adapted to modify said setting after predetermined periods of elapsed time. The present invention allows for a controlled time schedule for adjustments to the setting. In particular, it is possible to provide during the use of the hearing different intervals between subsequent modifications of the setting, e.g. by more frequent modifications during an early period of growth of the child user and less frequent modifications during a later period. In an embodiment, an early period of growth is defined as from 0 to 12 months, such as from 0 to 6 months. In an embodiment, a later period is defined as from 6 months and later, such as from 12 months and later. In an embodiment, the modifications are adapted to stop at a predefined end time, e.g. at an estimated age of 24 or 36 or 48 or 60 months. In an embodiment, the settings are updated or modified at predefined points in time, e.g. at a predefined update frequency (in relation to a unit of the timing unit). In an embodiment, the settings are updated in an early period of growth at an estimated update frequency larger than once a day, such as larger than once a week. In an embodiment, the settings are updated in a later period of growth at an estimated update frequency larger than once a month, such as larger than once a week. In an embodiment, the frequency range of the first (input) signal is split into a number of frequency ranges or bands, which are fully of partly processed separately. In an embodiment, the update frequency is different for different frequency bands. In an embodiment, the update frequency is larger for frequency bands representing relatively higher frequencies than for frequency bands representing relatively lower frequencies. In an embodiment, relatively lower frequencies are taken to mean frequencies smaller than 2 kHz, such as smaller than 1 kHz. In an embodiment, relatively higher frequencies are taken to mean frequencies larger than 1 kHz, such as larger than 2 kHz, such as larger than 3 kHz.

In an embodiment, the settings that are changed over time relate to insertion gain G. Typically, a frequency dependent insertion gain G(f) is adapted to a user's needs, where f is a frequency in the audible frequency range, e.g. between 20 Hz and 20 kHz (the hearing aid typically considering a sub-range of the audible frequency range, e.g. between 20 Hz and 4 kHz or 8 kHz or 12 kHz). In an embodiment, frequency dependent insertion gain is represented by a number N of parameters $g_i$, i=1, 2, . . . , N corresponding to a number N of frequency bands or ranges (e.g. N is larger than or equal to 2 or 4 or 8 or 64) into which the frequency range considered by the hearing aid is subdivided. In an embodiment, a set of initial parameters $g_{i0}$ are estimated or determined at the beginning of the use of the hearing aid (e.g. during a fitting procedure). In an embodiment, a number M of sets of parameters $g_{ij}$ are stored in a memory of the hearing aid, i=1, 2, . . . , N (frequency bands) and j=1, 2, . . . , M (points in time), each parameter set (j) corresponding to a particular (estimated) point in time. In an embodiment, the hearing aid is adapted to use the stored parameters corresponding to a given point time after the initial fitting, when that point in time is indicated by the timing unit. In an embodiment, the initial parameter set $g_{i0}$ is estimated based on average RECD-values for a child having an age corresponding to the user in question or simply measured RECD. In an embodiment, the initial parameter set $g_{i0}$ is determined based on the hearing profile for the child in question and actual measurements of $RECD_0(f)$ at an initial point in time $t_0$, e.g. during a fitting procedure. In an embodiment, an algorithm for the estimated development of RECD from an initial value (e.g. $RECD_0=RECD(t_0)$) at a particular age is used in a prediction of RECD-values at a later point in time. In an embodiment, the RECD(t)-algorithm is stored in the hearing aid. In an embodiment, the hearing aid is adapted to use the RECD(t)-algorithm to calculate RECD(t) values at a later point in time $t_j$ than the initial point in time $t_0$. ($t_j>t_0$) and to derive relevant gain parameters $g_{ij}$ for that time $t_j$. In an embodiment, an initial measurement during fitting is supplemented by one or more later measurements (e.g. 6 or 12 months after the initial fitting), whose results are used in the prediction of future RECD-values. In an embodiment, measurements of RECD-values are made with regular intervals (e.g. once a year or once every two years, e.g. by an audiologist), and RECD-predictions made by the hearing aid according to the previous measured RECD-values and an RECD-model (e.g. a linear extrapolation of two previous measurements) is used to modify the processing parameters in between such measurements.

In an embodiment, the formula for the digital adjustment of gain ($gain_{DSP}$) of the individual client (with RECD(t)) is:

$$gain_{DSP}=gain_{tecn}-RECD$$

where $gain_{techn}$ is the normal gain setting of the signal processing unit as determined during fitting.

Advantageously, both gain and MPO (maximum power output) of a hearing aid should be adjusted according to RECD. In an embodiment, the hearing aid is adapted to have separate (e.g. digital) controls for gain and MPO signal processing stages (cf. e.g. FIG. 3*a*). Often the hearing aid client wishes higher gain but has to accept a lower gain if a limiting stage (MPO) is not included in the hearing aid amplifier. It is therefore advantageous to include the MPO stage in the adaptation according to a time varying RECD. In an embodiment, the settings that are changed over time relate (also) to maximum power output MPO. Maximum power output parameters $MPO_{ij}$ for different frequency bands (i) and over time (j) may be estimated and possibly stored in the hearing aid or an RECD(t) algorithm is stored and used for the RECD and MOP-parameter-estimation as described above for the gain parameters $g_{ij}$. In an embodiment, the formula for the digital adjustment of MPO ($MPO_{DSP}$) of the individual client (with RECD(t)) is:

$$MPO_{DSP}=MPO_{techn}-RECD,$$

where $MPO_{techn}$ is the MPO measured with a 2 cc coupler. This formula expresses that for a child (with high value of RECD) then the DSP MPO will be reduced.

In an embodiment, the timing unit is adapted to regulate a digital gain stage as well as a digital MPO stage via a control unit.

In an embodiment, the control unit contains a suitable mathematical conversion unit, e.g. a logarithmic conversion unit, for operating on the timer output and a digital register in which one or more measured or estimated RECD values for a child as well as the corresponding age of the child are stored.

In a further embodiment of the invention said control unit is adapted to modify said setting continuously. The control unit is adapted for changing the setting whenever a change to the timing signal occurs. It is even possible to provide the timing signal as the setting itself, wherein the processing or generating of the second signal is either based on the setting or timing signal itself or on a value derived from said setting or timing signal.

According to a yet further embodiment of the invention said control unit is adapted for modifying said setting during a power-up or a power-down of said hearing device. By modifying or correcting the setting at the switching on or switching off of the hearing device a change in the hearing sensation during the operation of the hearing device is avoided which may otherwise cause an irritation to the user.

According to another embodiment of the present invention, said control unit is adapted for modifying said setting at a greater rate during an early period of elapsed time than during a later period of elapsed time. In particular in a case in which the hearing device according to the present invention is used for compensating the changes in the ear characteristics due to the growth of a child, the changes are not necessarily linear. In fact, typically the changes to the ear of a child are more rapid in the first year of life and become less over the time. The different rates of change during the use of the hearing device are reflected in the different modifications of the setting based on the total time elapsed.

In another preferred embodiment of the present invention said control unit is adapted for obtaining an initial setting from an external source. According to this embodiment the initial setting is provided, for example, during an initial fitting of the hearing device, based on conditions measured during the initial fitting and/or based on average or typical values.

In addition or as an alternative to the previous embodiment, the hearing device of the present invention according to another embodiment further comprises a calibration unit for determining an initial setting by measuring said characteristic of said user's ear. Provided with a (build-in) calibration unit the hearing device does not need external or additional means for determining the initial setting.

According to a further embodiment, said control unit is provided with a predetermined initial setting. The pre-defined initial setting, preferably based on average or typical settings obtained by experience and/or measured RECD, allows for a direct use of the hearing device without a need for an additional fitting. The fitting, however, may be performed at a later point in time.

According to an advantageous embodiment of the present invention, said signal processing unit is adapted for amplifying said first signal to generate said second signal based on said setting. In order to compensate for the change of the child's ear during growth it is most advantageous to adapt the amplification of the processed signal to the change in the characteristics of the ear. Nevertheless, according to the present invention, processing parameters other than the amplification in general may also be adapted.

In a further preferred embodiment of the present invention, said signal processing unit is adapted for applying a transfer function to said first signal to generate said second signal based on said setting. In addition or as an alternative to the adaptation of the amplification a complete transfer function may be changed or selected according to the setting, so the overall hearing sensation is adapted as well during the use of the hearing device.

According to another embodiment of the present invention, said characteristic of said user's ear is a real ear to coupler difference of said user's ear. The real ear to coupler difference is value or characteristic of the ear which is well-known. Typical values of the rate and amount of change of the RECD, for example during the growth of a child, are readily available, cf. e.g. [Dillon], chapter 15, 'Special hearing aid issues for children', specifically chapter 15.4.3, 'Allowing for small ear canals', pp. 416-419.

In an embodiment, the input unit comprises an input transducer, e.g. a microphone. In an embodiment, the output unit comprises an output transducer, e.g. a receiver.

In an embodiment, the hearing aid device is body worn or capable of being body worn. In an embodiment, the input and output units are located in the same physical body. In an embodiment, the hearing aid device comprises at least two physically separate bodies which are capable of being in communication with each other by wired or wireless transmission (be it acoustic, ultrasonic, electrical or optical). In an embodiment, a first input unit is located in a first body and a second input unit is located in a second body of the hearing aid device. In an embodiment, a first input unit is located in a first body together with the output unit and a second input unit is located in a second body. In an embodiment, a first input unit is located in a first body and the output unit is located in a second body. In an embodiment, a second input transducer is located in a third body. The term 'two physically separate bodies' is in the present context taken to mean two bodies that have separate physical housings, possibly not mechanically connected or alternatively only connected by one or more guides for acoustical, electrical or optical propagation of signals.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present. Furthermore, "connected" or "coupled" as used herein may include wirelessly connected or coupled. As used herein, the term "and/or" includes any and all combinations of one or more of the associated listed items.

In the following, exemplary embodiments of the present invention are further explained referring to the attached drawings, in which FIG. 1 shows a hearing device according to an embodiment of the present invention, and FIG. 2 shows a method for providing a hearing aid according to an embodiment of the present invention.

Figure 5:
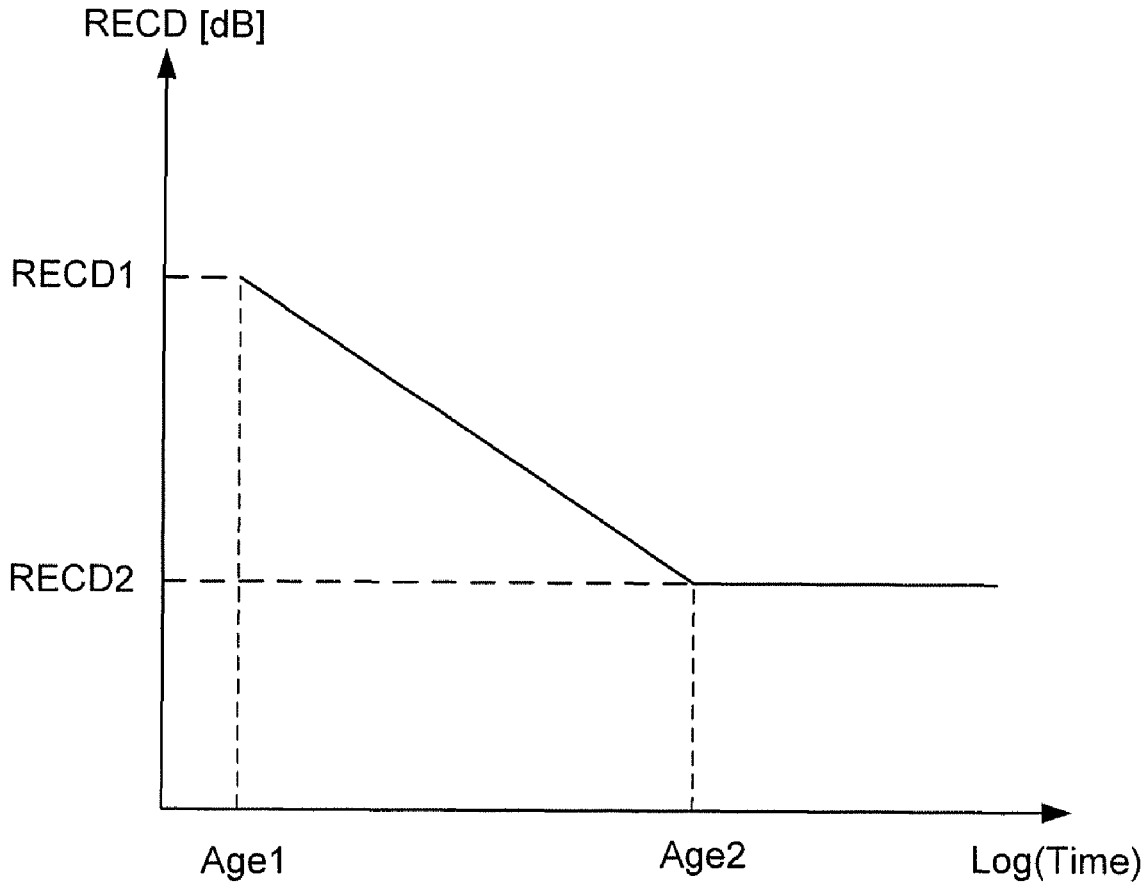

FIG. 5 schematically illustrates a model for the expected development of RECD with time for a child.

Figure 1:
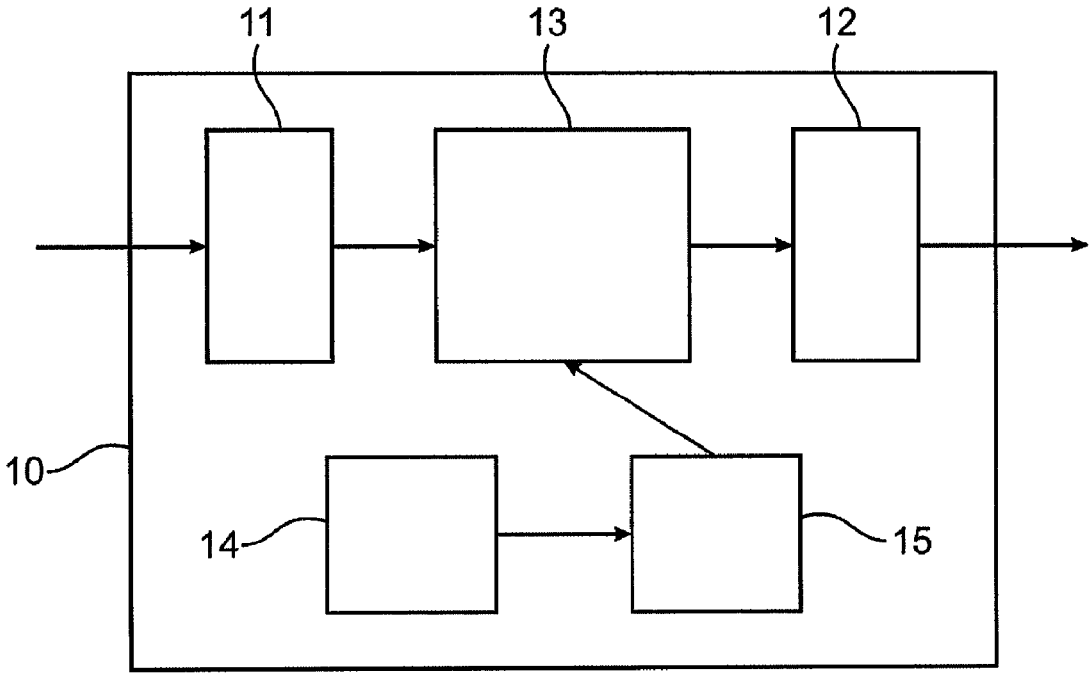

FIG. 1 shows a hearing device according to an embodiment of the present invention. The hearing device 10 comprises an input unit 11 for converting an acoustic input to a first signal, an output unit 12 for converting a second signal to an acoustic output and a signal processing unit 13 for generating said second signal from said first signal based on a setting, wherein the signal processing unit 13 couples said input unit 11 and said output unit 12. In regard of the input unit 11, the output unit 12 and the signal processing unit 13 the hearing device of the invention basically corresponds to known hearing devices of different types, so that a detailed description of the design and the operation of these units may be omitted here. A programmable hearing aid is e.g. described in EP 0 681 411.

The hearing device 10 further comprises a timing unit 14 and a control unit 15. The timing unit 14 is coupled to the control unit 15 and provides the control unit 15 with a timing signal indicating elapsed time. The timing unit 14 may be of any suitable design. Examples of suitable timing units are real-time clocks, uptime clocks and power-up- or power-down-counters. The timing unit may be implemented as an integrated circuit or by means of software executed on a suitable processor. The control unit 15 is adapted for storing a setting and providing the signal processing unit 13 with this setting. Further, the control unit 15 is adapted for receiving the timing signal from the timing unit 14 and for modifying the (stored) setting based on the timing signal. Again, the control unit 15 may be implemented by any suitable means, including a processor running software or an integrated circuit.

Figure 2:
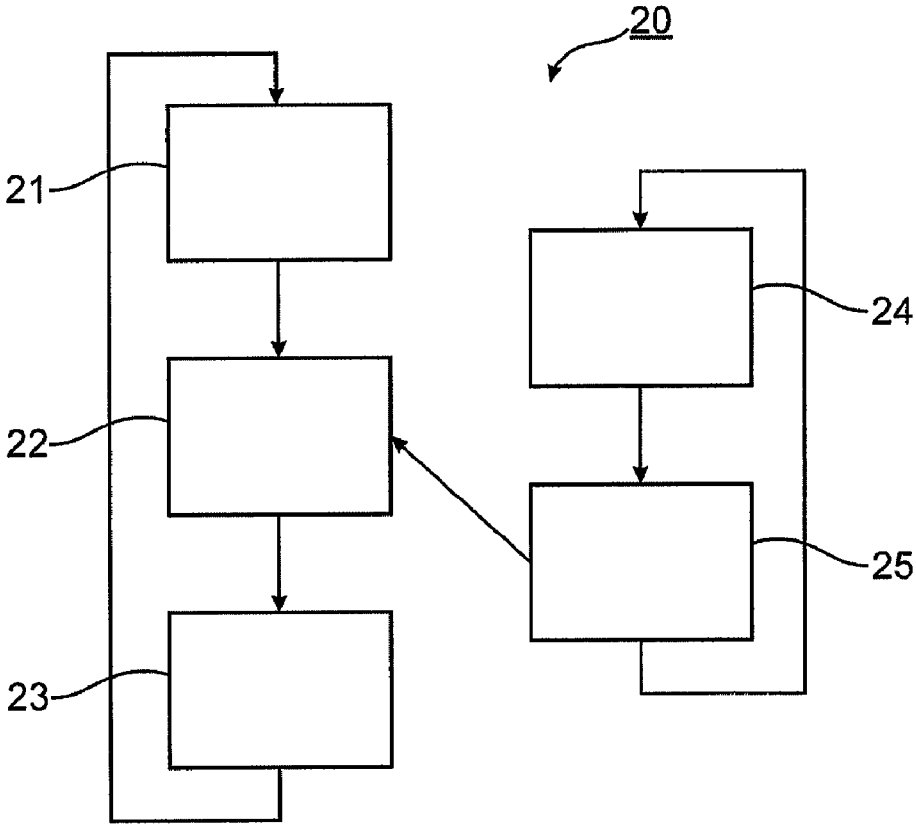

FIG. 2 shows a method for providing a hearing aid according to an embodiment of the present invention. The method 20 for providing a hearing aid comprises the steps of converting an acoustic input to a first signal (step 21), generating a second signal from said first signal based on a setting (step 22) and converting said second signal to an acoustic output (step 23). These steps are repeated and are common steps for a method of operation of a hearing device. Thus, a more detailed explanation may be omitted here. In step 24 a timing signal indicating elapsed time is generated and in step 25 this timing signal is used for modifying said setting, resulting in a modified generation of the second signal from the first signal (step 22). The steps 24 and 25 are repeated during the course of the method 20 as well.

The present invention allows for a simple and inexpensive implementation. According to one embodiment of the present invention, the hearing device or hearing aid 'knows' the initial settings of the hearing aid, the current RECD corrections and the amount of time until the child has adult sized ear canals. From this data a range of intermediate settings are created to reflect the growth of the ear canal over time. The hearing aid will then use a data logging function to calculate the passage of time and update the corrections from time to time to match the growth of the ear canal. These corrections are calculated at start-up so that the child does not experience a large change in listening quality. The changes over time are made in stages that are calculated based on the child's current age and the amount of time between the date of assessment and when the child's ear canals are adult size (for example based on an assumption of 7 years). The changes are more rapid in the first year of life and become less over time, cf. e.g. [Dillon], table 15.2, p. 417 displaying average RECD values for children of different ages at different frequencies. [Bagatto et al.] provides algorithms for calculating normative RECD predicted values vs. frequency for a range of child ages. Such data or equivalent data together with information on elapsed time $t_i$ from an initial or start time $t_0$ may form the basis of corrections of parameter settings at $t_i$. The initial data (stored in the hearing aid at a start time $t_0$) may preferably be collected from the user (and be based on measurements on the user in question, including an individual RECD measurement). Alternatively, average correction values may be used (e.g. based on average initial values and assumptions of average development of RECD with age, e.g. as described by [Bagatto et al.]).

The hearing aid then automatically makes changes based on the amount of time logged. A listening day is assumed to be 10 hours (but another value can be entered in the fitting program). Once a set period of time has been reached that is concomitant to a change in ear canal volume the new corrections are used. The corrections and speed may additionally be adjusted when the dispenser connects the hearing aid to the fitting software. These could be done each time the child visits the audiologist. The corrections in the hearing aid can be read and compared with predetermined values.

Figure 3A:
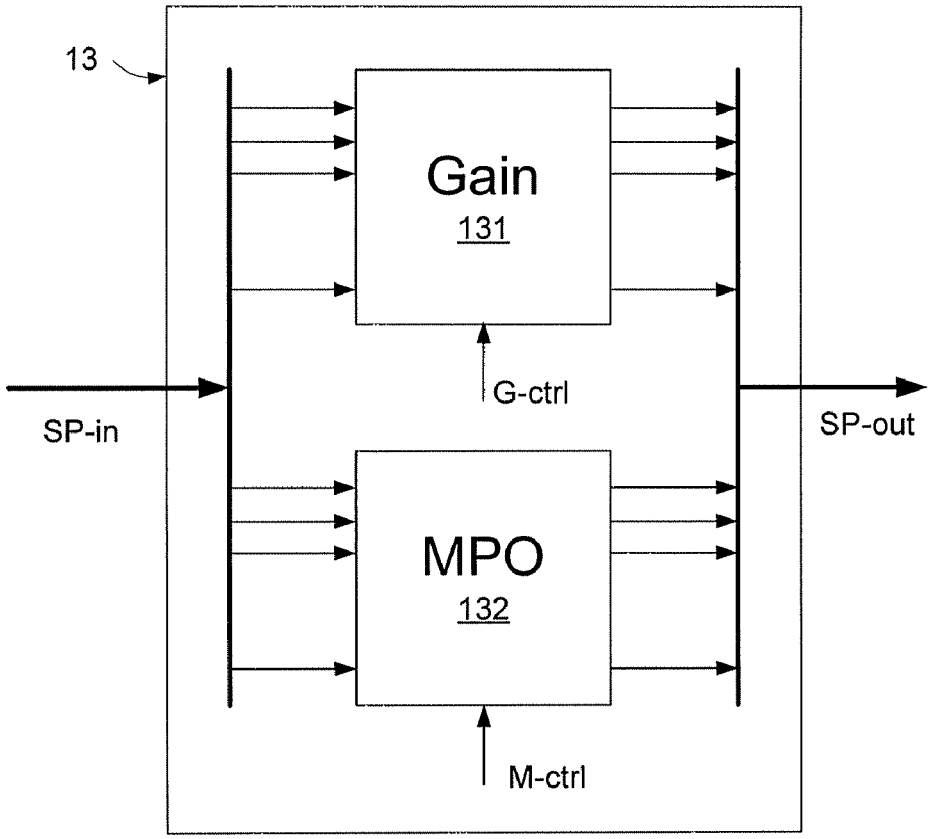
FIG. 3 shows examples of a digital signal processing unit comprising (FIG. 3*a*) and a control unit 15 (FIG. 3*b*) for hearing device according to an embodiment of the present invention.
Figure 3B:
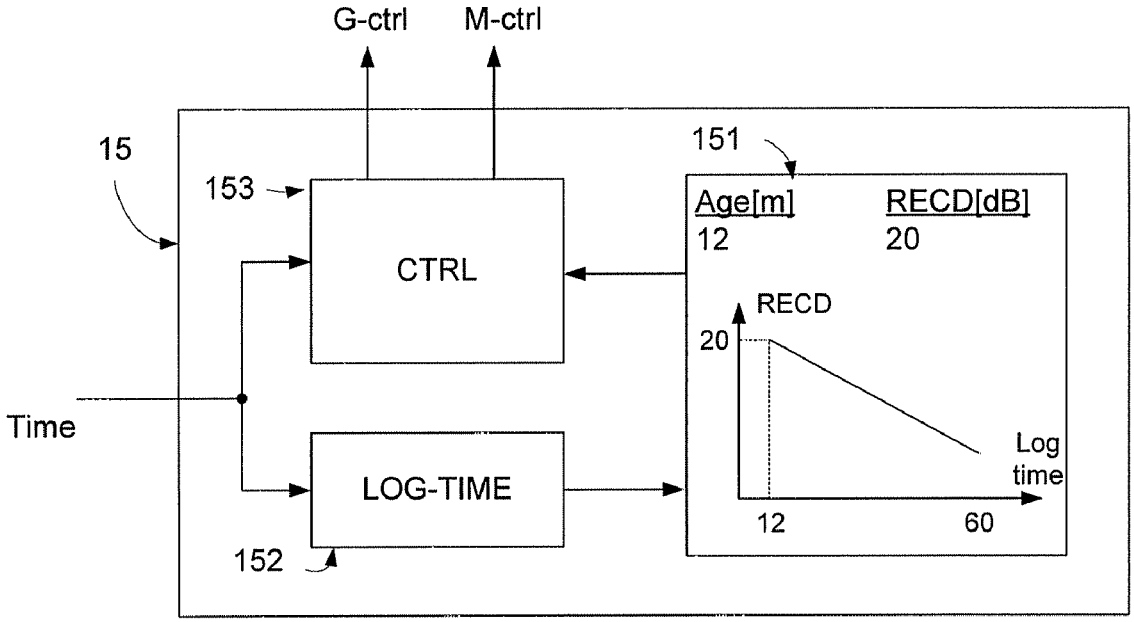

FIG. 3 shows further details of the signal processing unit 13 (FIG. 3*a*) and control unit 15 (FIG. 3*b*). FIG. 3*a* shows an example of a digital signal processing unit 13 comprising a digital gain stage 131 and a digital MPO stage 132 for implementing separate adjustment of gain and MPO. The splitting of the input signal in a number of frequency ranges or bands is indicated on the input (signals SP-in) and output (signals SP-out) sides of the signal processing unit 13. The Gain block 131 and MPO block 132 each gets respective control inputs G-ctrl and M-ctrl from control unit 15 (see FIGS. 1 and 3*b*). FIG. 3*b* comprises a control unit 15 comprising a digital register 151 comprising corresponding values of child age and RECD adapted for implementing an adjustment of processing parameters (e.g. gain and/or MPO) of the hearing aids over time based on the stored values of child age and RECD. In the embodiment of FIG. 3*b*, the register or memory 151 comprises corresponding initial values of child age and RECD and a logarithmic model of RECD-development with time between the initial value ((Age1, RECD1) in FIG. 5) and an end value ((Age2, RECD2) in FIG. 5) (after which the ear canal changes are less rapid) thereby enabling the calculation of appropriate gain and MPO settings for any later point in time. A LOG-TIME unit 152 provides a logarithmic representation of the current time (based on TIME input from the timing unit 14 (cf. FIG. 1), which is used as an input to the register 151 to allow a determination of the current RECD from the model. The determined current RECD value is read by CTRL unit 153, which initiates the setting of the appropriate gain and/or MPO values in the signal processing unit 13 via control signals G-ctrl and M-ctrl, respectively. The appropriate gain and MPO values may be calculated in the CTRL-unit 153 in the signal processing unit 13.

Figure 4A:
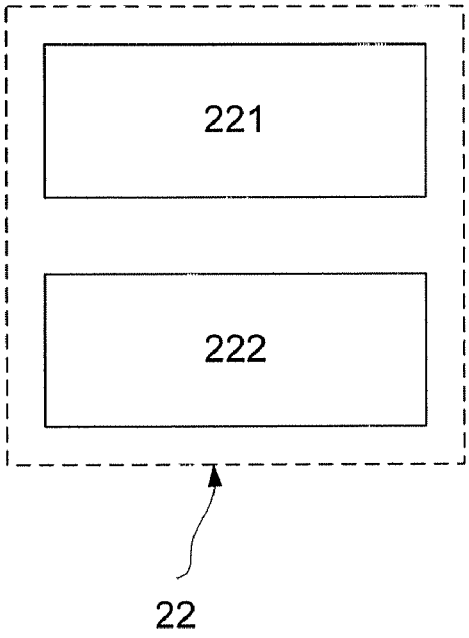
FIG. 4 shows further details of the signal generating step 22 (FIG. 4*a*) and a setting modifying step 25 (FIG. 4*b*).
Figure 4B:
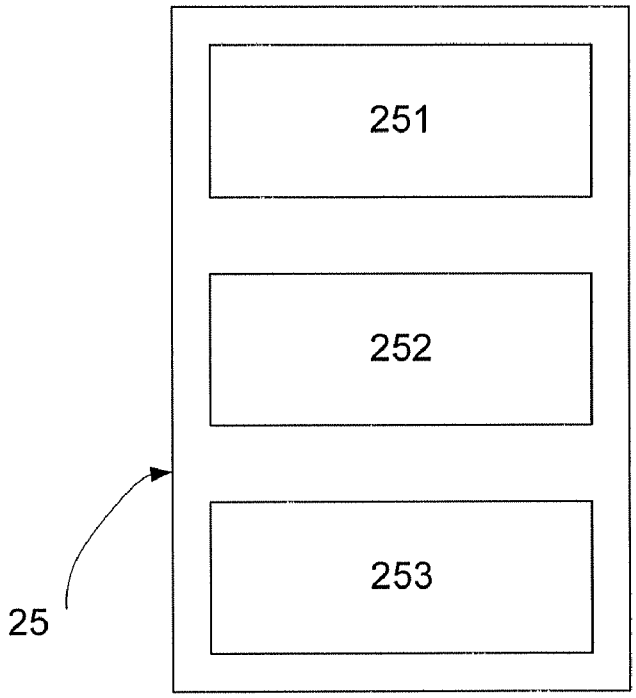

FIG. 4 shows further details of the signal generating step 22 (FIG. 4*a*) and a setting modifying step 25 (FIG. 4*b*). FIG. 4*a* shows an example of a signal generating step comprising a gain generating step 221 and/or an MPO generating step 222 for implementing separate adjustment of gain and MPO. FIG. 4*b* shows an example of a setting modifying step 25 comprising a time adjusting step 251 (e.g. for preparing a logarithmic or other mathematical representation of time), a storing and estimating step 252 comprising storing corresponding values of child age and RECD (e.g. in the form of at least one initially measured RECD-value and an algorithm for estimating later RECD values) and determining an RECD value corresponding to a specific current time, and a control signal generating step 253 for generating control signals for initiating (and/or calculating) an adjustment of processing parameters (e.g. gain and/or MPO) of the hearing aid over time based on the determined RECD-value for the current time.

FIG. 5 shows a model of the development of RECD with time on a logarithmic scale. The model shows a linear dependence of RECD with the logarithm of time as e.g. expressed by $RECD(t)=b_0+b_1\cdot\ln(t)$, as proposed by [Bagatto et al.], where RECD is in dB and t is child age in months in a range from Age1 to Age2. Preferably, the start value RECD1 of the Real ear to coupler difference at a start time (Age1 in FIG. 5), e.g. at a child age of 12 months, is measured on the specific child who is to wear the hearing aid in question. Preferably, start values $RECD1_i$ for a number of (such as all) frequency bands of the active frequency range considered by the hearing aid (i=1, 2, . . . , N) are measured for the specific child who is to wear the hearing aid in question. In an embodiment, corresponding start values of RECD and child age are stored in a memory of the hearing aid for a number of frequencies of the active frequency range of the hearing aid. In an embodiment, a model for each frequency band for which corresponding start values of RECD and child age are stored in the hearing aid are likewise stored in the hearing aid to allow individual predictions of RECD with child age for different frequency ranges of the audible frequency range considered by the hearing aid. In an embodiment, the frequency range between a minimum frequency (e.g. 20 Hz) and a maximum frequency (e.g. 4 kHz or 8 kHz or 12 kHz) is considered by the hearing aid. Instead of a logarithmic model of RECD(t) as suggested by [Bagatto et al.] any other appropriate extrapolation or prediction technique based on individual RECD start-measurements towards standard adult RECD values (at Age2 in FIG. 5) can be used. In an embodiment, an initial measurement during fitting is supplemented by one or more later measurements (e.g. 6 or 12 months after the initial fitting), whose results are used in the prediction of future RECD-values.

According to a further embodiment the present invention provides a hearing aid or hearing device with a sound signal capturing transducer, a sound signal processing means and a transducer for delivering a sound signal to the ear canal of a user, whereby further an ear mould is provided which encloses a residual air volume between the tympanic membrane and the mould whereby the amplification given to the sound signal is adjusted according to the size of the residual volume. According to this embodiment the amplification is adjusted automatically with respect to expected changes over time of the residual air volume. It is preferable that the automatic adjustment over time corresponds to average growth curves for ears of children, whereby an age of the child receiving the hearing aid is provided as starting point for the adjustment. It is further preferable that the automatic adjustment over time corresponds to the average variation during the daytime of a user's residual volume. In an advantageous embodiment a timer function is provided in order for the hearing aid to know time of day or lapsed time since initial use.

REFERENCES

[Dillon] Harvey Dillon, Hearing Aids, Thieme, 2001

EP 1 617 705 A2 (Phonak AG) 18 Jan. 2006

U.S. Pat. No. 6,658,122 (Widex A/S) 18 May 2000

US 2005/0105741 A1 (Siemens Corp.) 19 May 2005

EP 1 594 344 A2 (Phonak AG) 9 Nov. 2005

EP 0 681 411 B1 (Siemens Audiologische Technik GmbH) 8 Nov. 1995

[Bagatto et al.] M. P. Bagatto, S. D. Scollie, R. C. Seewald, K. S. Moodie, B. M. Hoover, Real-Ear-to-Coupler Difference Predictions as a Function of Age for Two Coupling Procedures, J. Am. Acad. Audiol., Vol. 13, 2002, p. 407-415

The invention claimed is:

1. An adaptive hearing device for being worn by a child user, the hearing device comprising:

an input unit for converting an acoustic input to a first signal, an output unit for converting a second signal to an acoustic output, a signal processing unit for generating said second signal from said first signal based on a setting of parameters indicating a characteristic of the child user's ear, said signal processing unit coupling said input unit and said output unit, wherein the signal processing unit comprising a digital gain stage and a digital maximum-power-output stage for implementing separate adjustment of gain and maximum power output, a timing unit for generating a timing signal indicating elapsed time, and a control unit for storing said setting of parameters and for modifying said setting of parameters based on said timing signal, said control unit being coupled to said signal processing unit and to said timing unit, and wherein said control unit contains a mathematical conversion unit for the timing unit and a digital register, the digital register storing an initial parameter set based on:

one or more measured or estimated real-ear-to-coupler-difference values for the child user; and an initial age of the child user, the digital register further storing at least one of:

a pre-defined look-up table of average values of real-ear-to-coupler-difference (RECD) at different ages; and an algorithm for determining a time-adjusted real-ear-to-coupler-difference value (RECD) from the initial parameter set and an estimated current age, said control unit adapted for automatically determining the estimated current age and the RECD in relation to the initial parameter set, and implementing an adjustment of the digital gain and/or the digital maximum-power-output of the hearing device over time, wherein the adjustment of the digital gain is, at a given time:

$$\text{digital gain}=\text{gain}_{techn}-\text{RECD}$$

wherein $\text{gain}_{techn}$ is an initial digital gain as determined during fitting, and wherein the adjustment of the digital maximum-power-output is, at a given time:

$$\text{digital maximum-power-output}=\text{MPO}_{techn}-\text{RECD}$$

wherein $\text{MPO}_{techn}$ is an initial digital maximum-power-output measured with a 2 cc coupler during fitting.

2. The hearing device according to claim 1, wherein said timing unit comprises at least one of:

a real-time clock for measuring time, an uptime clock for measuring an uptime in which said hearing device is in operation, and a power-up counter for counting a number of power-ups of said hearing device.

3. The hearing device according to claim 2, wherein said timing unit comprises said uptime clock and wherein said timing unit is adapted for generating said timing signal based on said uptime multiplied by a predetermined time-factor.

4. The hearing device according to claim 3, wherein said predetermined time-factor is in the range of 1.5 to 4.0.

5. The hearing device according to claim 2, wherein said timing unit comprises said power-up counter and wherein said timing unit is adapted for generating said timing signal based on said number of power-ups multiplied by a predetermined time-value.

6. The hearing device according to claim 5, wherein said predetermined time-value is in the range of 6 hours to 24 hours.

7. The hearing device according to claim 1, wherein said control unit is adapted for modifying said setting based on said timing signal and said predefined look-up table.

8. The hearing device according to claim 1, wherein said control unit is adapted for modifying said setting based on said timing signal using the algorithm.

9. The hearing device according to claim 1, wherein said control unit is adapted to modify said setting after predetermined periods of elapsed time.

10. The hearing device according to claim 1, wherein said control unit is adapted to modify said setting whenever a change to the timing signal occurs.

11. The hearing device according to claim 1, wherein said control unit is adapted for modifying said setting during a power-up or a power-down of said hearing device.

12. The hearing device according to claim 1, wherein said control unit is adapted for modifying said setting at a greater rate during an early period of elapsed time than during a later period of elapsed time.

13. The hearing device according to claim 1, wherein said control unit is adapted for obtaining an initial setting from an external source.

14. The hearing device according to claim 1, further comprising a calibration unit for determining an initial setting by measuring said characteristic of said user's ear.

15. The hearing device according to claim 1, wherein said signal processing unit is adapted for amplifying said first signal to generate said second signal based on said setting.

16. The hearing device according to claim 1, wherein said signal processing unit is adapted for applying a transfer function to said first signal to generate said second signal based on said setting.

17. The hearing device according to claim 1, wherein said characteristic of said user's ear is a real ear to coupler difference of said user's ear.

18. A non-transitory computer-readable medium encoded with instructions which, when executed, cause a hearing device according to claim 1 to perform the following operations:

A. converting the acoustic input to the first signal,

B. generating the second signal from said first signal based on the setting of parameters indicating a characteristic of the child user's ear, C. converting said second signal to the acoustic output, D. generating the timing signal indicating elapsed time, and E. modifying said setting of parameters based on said timing signal, wherein the modification includes separate adjustment of gain and maximum power output, and wherein the modification is based on the initial parameter set and stored information:

the initial parameter set based on:

one or more measured or estimated real-ear-to-coupler-difference values for the child user; and the initial age of the child user, the stored information including at least one of:

the pre-defined look-up table of average values of real-ear-to-coupler-difference (RECD) at different ages; and the algorithm for determining a time-adjusted real-ear-to-coupler-difference (RECD) from the initial parameter set and an estimated current age, said modifying comprising automatically determining the estimated current age and the RECD in relation to the initial parameter set, and implementing an adjustment of the digital gain and/or the digital maximum-power-output of the hearing device over time, wherein the adjustment of the digital gain is, at a given time:

$$\text{digital gain}=\text{gain}_{techn}-\text{RECD}$$

wherein $\text{gain}_{techn}$ is an initial digital gain as determined during fitting, and wherein the adjustment of the digital maximum-power-output is, at a given time:

$$\text{digital maximum-power-output}=\text{MPO}_{techn}-\text{RECD}$$

wherein $\text{MPO}_{techn}$ is an initial digital maximum-power-output measured with a 2 cc coupler during fitting.

19. The hearing device according to claim 1, wherein said mathematical conversion unit is a logarithmic conversion unit.

20. A method for operating a hearing device, comprising the steps of:

A. converting an acoustic input to a first signal,

B. generating a second signal from said first signal based on a setting of parameters indicating a characteristic of a user's ear, C. converting said second signal to an acoustic output, D. generating a timing signal indicating elapsed time, and E. modifying said setting of parameters based on said timing signal, wherein the modification includes separate adjustment of gain and maximum power output, and wherein the modification is based on an initial parameter set and stored information:

the initial parameter set is based on:

one or more measured or estimated real-ear-to-coupler-difference values for the child user; and an initial age of the child user, the stored information including at least one of:

a pre-defined look-up table of average values of real-ear-to-coupler-difference (RECD) at different ages; and an algorithm for determining a time-adjusted real-ear-to-coupler-difference (RECD) from the initial parameter set and an estimated current age, said modifying comprising automatically determining the estimated current age and the RECD in relation to the initial parameter set, and implementing an adjustment of the digital gain and/or the digital maximum-power-output of the hearing device over time, wherein the adjustment of the digital gain is, at a given time:

$$\text{digital gain}=\text{gain}_{techn}-\text{RECD}$$

wherein $\text{gain}_{techn}$ is an initial digital gain as determined during fitting, and wherein the adjustment of the digital maximum-power-output is, at a given time:

$$\text{digital maximum-power-output}=\text{MPO}_{techn}-\text{RECD}$$

wherein $\text{MPO}_{techn}$ is an initial digital maximum-power-output measured with a 2 cc coupler during fitting.

* * * * *